US005718305A

United States Patent [19]

Palmer

[11] Patent Number: 5,718,305

[45] Date of Patent: Feb. 17, 1998

[54] SAFETY HARNESS ATTACHMENT POST ASSEMBLY

[76] Inventor: Theodore Richard Palmer, Unit #5 10 Pinelands Avenue, Stoney Creek Ontario, Canada, L8E 3A5

[21] Appl. No.: 742,808

[22] Filed: Nov. 1, 1996

[51] Int. Cl.[6] ..... E04G 3/12

[52] U.S. Cl. ..... 182/45; 182/3

[58] Field of Search ..... 182/3, 45, 113; 256/DIG. 6, 65, 67

[56] References Cited

U.S. PATENT DOCUMENTS

| | | | |
|---|---|---|---|
| 4,078,633 | 3/1978 | Fahy | 182/45 |
| 4,957,185 | 9/1990 | Courchesne | 182/45 |
| 5,029,670 | 7/1991 | Whitmer | 182/113 |
| 5,361,558 | 11/1994 | Thornton | 182/3 |
| 5,515,941 | 5/1996 | Palmer et al. | 182/45 |

*Primary Examiner*—Alvin C. Chin-Shue
*Attorney, Agent, or Firm*—McConnell and Fox

[57] ABSTRACT

A post assembly for attaching a worker safety harness to a structure comprises a post member having two transversely spaced wall attachment assemblies at its lower end and on opposite sides thereof and a roof attachment assembly intermediate its ends, the assemblies being releasable to enable the post assembly to be removed while the parts attached to the wall and roof remain for re-use. The assemblies have attachment axes that diverge toward the wall to increase the transverse spacing between the attachment points as the spacing from the wall increases. The spacing of the wall assemblies and their placement on opposite sides of the post ensures that part of any sideways acting force is converted from undesirable shear peeling force to compressive force on one wall assembly and tension force on the other assembly. The part of each attachment assembly that contacts a surface may comprise a central plate with one or more side and/or end plates hinged thereto to accommodate curvature of the roof surface. Preferably, the attachment members are fastened to the structure surfaces by adhesive. The post member comprises an upper telescoping part so that its length can be adjusted as required, and a lower telescoping part to adjust the vertical distance between the wall and roof assemblies. A stub post assembly is used for installation to ensure that the attachment plates are accurately located for subsequent re-use.

17 Claims, 2 Drawing Sheets

SAFETY HARNESS ATTACHMENT POST ASSEMBLY

FIELD OF THE INVENTION

This invention provides a post assembly adapted for attachment to a wall or equivalent wall-like surface of a structure and for the attachment thereto directly or indirectly of a safety harness worn by a person working on a roof or equivalent roof-like surface of the structure. The invention also provides a stub post assembly for use in the mounting of such a post assembly on a structure.

REVIEW OF THE PRIOR ART

It is an increasing requirement when persons work on high above ground roof or roof-like surfaces of various structures, for example for the purpose of repair and maintenance, to provide against the possibility of accidental falls to the ground below. Examples of such structures on which such work is performed are buildings of all kinds, storage tanks, chemical reactors, electric transformers, electric circuit breakers, bridges and cranes. Since a fall of quite a short distance can cause serious injury, or even death, the provision of such safety means is desirable when the height of the surface above the ground is as small as about 2 meters (6 feet), and some jurisdictions now require a safety installation of some kind for all work above this height. A common relatively inexpensive installation comprises a safety harness for each worker that is releasably attached by a tether line and snap hook or shackle to a secure point on the structure, or to a catenary or travelling restraint line extending between two spaced secure points and along which the snap hook or shackle can slide. Such a secure point or points must of course be strong enough to withstand the forces applied thereto by a falling body, and high enough to permit use of a tether line long enough not to obstruct free movement of the worker on the work surface, while short enough for a falling body not to reach the ground. It is usually extremely difficult to find existing attachment points that are suitable, especially on structures that were built before such a requirement was envisaged, and there is therefore the need for an assembly providing such a point that can readily be attached to the structure as and when required, and preferably also readily removed when the job is finished so that it can be used elsewhere. The provision of such an assembly is not particularly difficult when the working surface is a building or tank roof surface that is flat, horizontal and uncluttered, since it can then be a simple pole or mast supported by a socket fastened securely to the roof surface, but this often is inconvenient, or even impossible, for example because of the roof construction, because of other structures on the roof surface, or because the surface is domed or sloped, so that instead the pole or mast can only conveniently be fastened to a side wall.

SUMMARY OF THE INVENTION

It is a principal object of the invention therefore to provide a post assembly adapted for ready attachment to a structure side wall as and when required and for ready attachment thereto of a safety harness or travelling restraint line.

It is another object to provide such a post assembly with which the major part thereof can be moved from structure to structure as required, so that effectively it becomes part of the safety harness that the worker carries from job to job.

It is a further object to provide such a new post assembly adapted for use when the wall and/or roof surfaces are curved, as with a cylindrical dome-roofed metal tank.

It is a further object to provide such a new post assembly having wall surface and roof surface engaging parts that can be permanently installed on the structure, making it even simpler and less expensive to re-install the post assembly whenever required.

It is a further object to provide a stub post assembly that facilitates ready installation of a post assembly in such a manner that wall surface and roof surface engaging parts can be left in place and used subsequently for installation of a different but similar post assembly.

It is a further object to provide such a post assembly and such a new stub post assembly that are simple and inexpensive both to manufacture and for installation of the post assembly, assisting in ensuring that they will be used, especially with relatively small jobs where cost may be a prime consideration.

In accordance with the invention there is provided a safety harness attachment post assembly for attachment to a wall surface and a roof surface of a structure comprising:

a post member which when attached to the wall surface extends generally vertically with an upper end above the roof surface and a lower end below the roof surface, the post member having at its upper end means for releasable attachment thereto of a safety harness permitting movement of a worker wearing the harness on the roof surface;

two transversely spaced separable wall attachment assemblies at or adjacent to the post member lower end on opposite sides thereof and each adapted for releasable attachment of the post assembly to the wall surface, each wall attachment assembly comprising a wall attachment member attachable to the wall surface and having a first connection part, a second connection part on the post member, and connecting means separably connecting together the first and second connection parts;

the transverse spacing of the two wall attachment assemblies and their disposition on opposite sides of the post member providing that part of sideways force acting parallel to the wall surface and applied by the safety harness to the post member and thereby to the wall attachment members is converted from shear peeling force to compressive force acting inward toward the wall surface on one wall attachment member and to tensile force acting outward away from the wall surface on the other wall attachment member; and a roof attachment assembly intermediate the post member ends for releasable attachment of the post assembly to the roof surface, the assembly having a first connection part attachable to the roof surface, a second connection part on the post member, and connecting means separably connecting together the first and second connection parts.

Also in accordance with the invention there is provided a safety harness attachment stub post assembly for use instead of a post assembly for attachment of the two transversely spaced wall surface attachment members to the wall surface of a structure and for attachment of the roof surface attachment member to the roof surface, the stub post member also comprising two transversely spaced separable wall attachment assemblies at or adjacent to its lower end on opposite sides thereof, and a roof attachment assembly at its upper end, as with the post member.

The second connection part of each wall attachment assembly may have a longitudinal axis that when the post assembly is installed intersects the wall surface and along which the distance of the lower end of the post member from the respective wall attachment member can be adjusted, and wherein the two axes diverge away from one another toward the wall surface whereby the transverse spacing between the wall attachment members increases as the spacing increases of the lower end of the post member from the wall surface.

DESCRIPTION OF THE DRAWINGS

A safety harness attachment post assembly and a safety harness attachment stub post assembly that are particular preferred embodiments of the invention will now be described, by way of example, with reference to the accompanying diagrammatic drawings, wherein.

For convenience similar or equivalent parts are given the same reference number in all the Figures of the drawings wherever that is possible.

DESCRIPTION OF THE PREFERRED EMBODIMENTS

Figure 1:
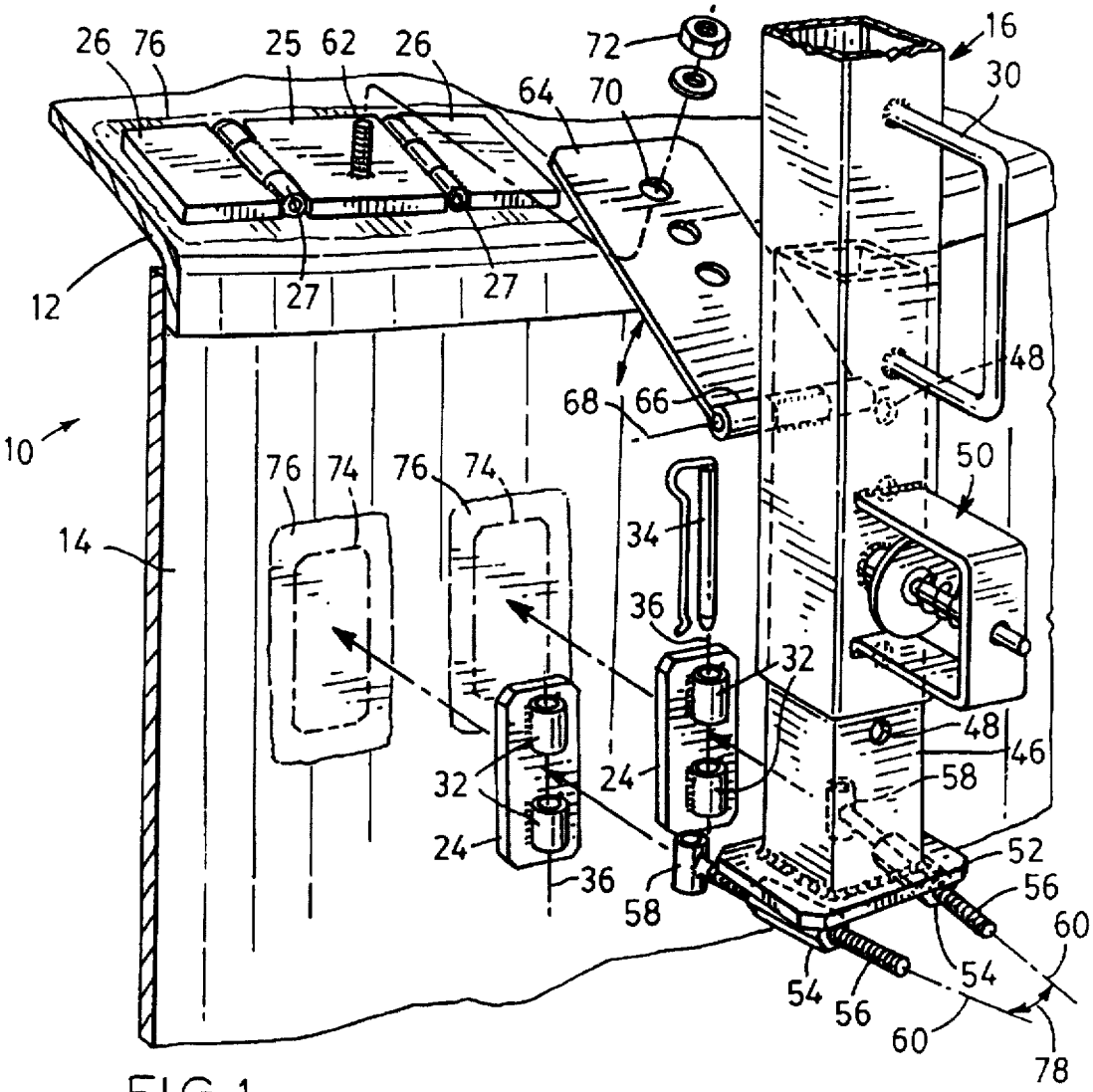
FIG. 1 is a partly exploded perspective view of a stub post assembly and illustrating the manner in which it is used to attach wall attachment members and a roof attachment member respectively to the wall and roof surfaces of a structure for subsequent installation of a full length post assembly.
Figure 2:
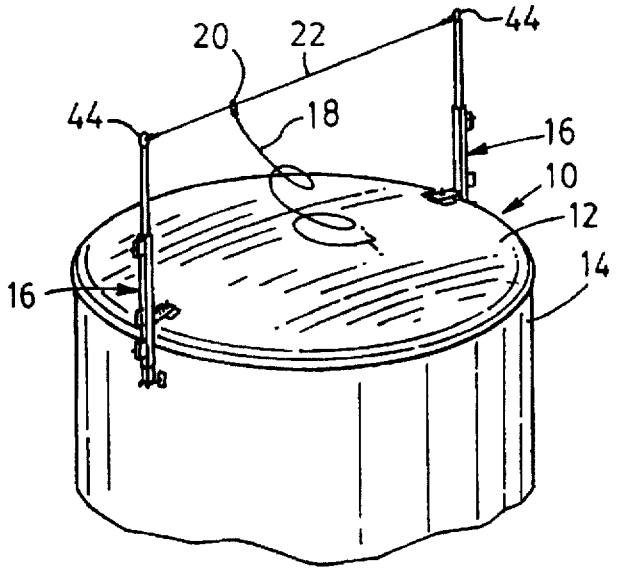
FIG. 2 is a side elevation from above and to one side of an example of a structure with which the invention can be used, comprising a cylindrical dome-topped metal tank, and illustrating the arrangement of two spaced post assemblies supporting a catenary or travelling restraint line along which one end of a safety harness tether line can slide.

FIG. 1 shows in perspective a portion of the upper edge of a structure 10, comprising in this embodiment a steel tank having a domed roof surface 12 and a cylindrical wall surface 14, the tank being of a size such that service personnel can move about on its roof surface, which is considerably higher than 2 meters (6 feet) above the surrounding ground. For convenience in language and description the term roof surface includes any flat or non-flat surface that can be walked on by service personnel, and the term wall surface includes any surface operative as a wall, whether vertical or not, to which a post assembly can be attached. Thus, structures such as bridges and cranes have horizontal or nearly horizontal surfaces on which service personnel can move, and are therefore equivalent to the roof surface of a building or tank, and have vertical or nearly vertical surfaces which are equivalent to the wall surface of a building or tank, and to which post assemblies can be fastened. For simplicity in illustration various ancillary structures that may be mounted on the roof and wall surfaces are not shown.

In the absence of a guard rail enclosing the roof surface some other safety installation must be provided, and generally a safety harness for each worker is the most economical in cases where only a few workers are required and/or work on the roof surface is infrequent. As explained above the use of such a safety harness requires a strong secure attachment point at a suitable height above the roof surface, and this is provided either directly by a vertically extending post assembly 16, to which is attached a tether line 18 of a safety harness (not shown) using a snap hook or shackle 20, or indirectly by a catenary or travelling restraint line 22 strung between two spaced post assemblies, along which line the hook or shackle can slide freely. The post assembly and its attachment are sufficiently strong that two workers can attach their harnesses to a single assembly. If the roof surface is large then, because of their economy in manufacture and ease of installation a number of post assemblies can be provided spaced around the roof edge.

Figure 3:
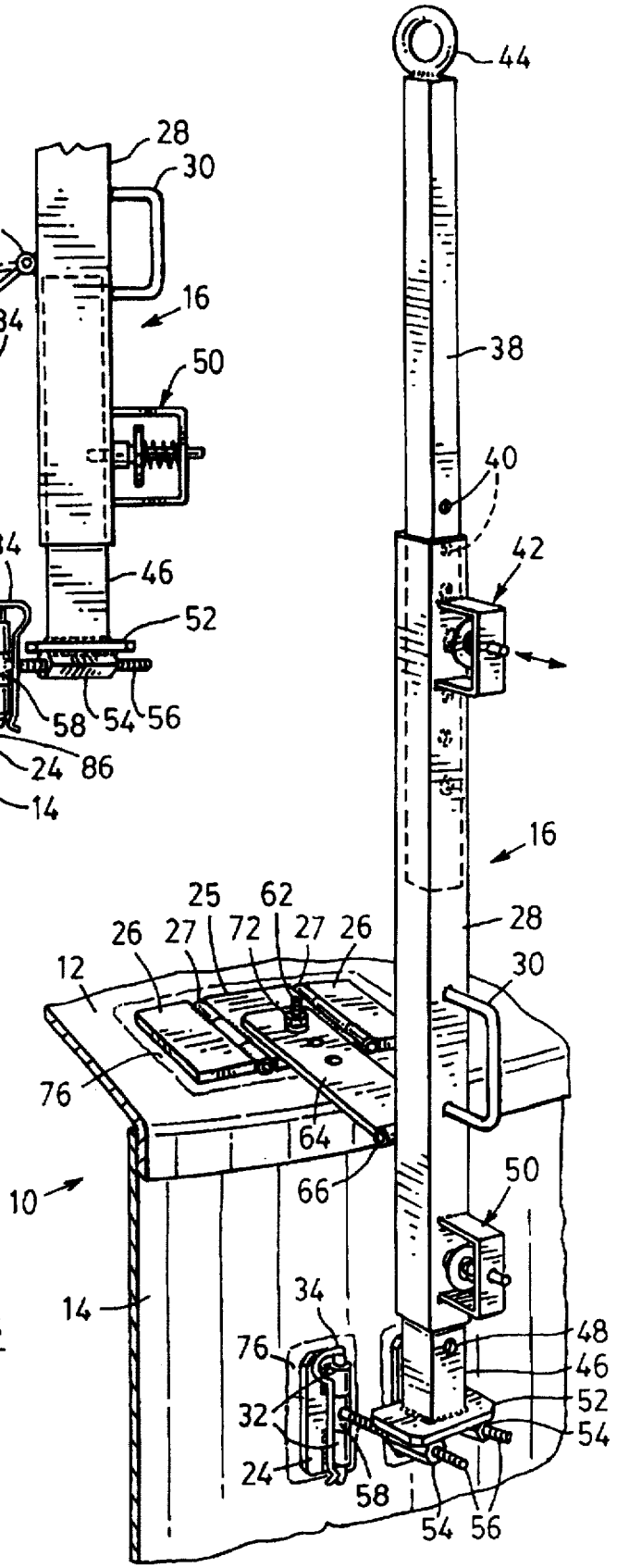
FIG. 3 is a perspective view of an installed post assembly drawn to a smaller scale than FIG. 1.

Referring now also to FIG. 3, the post assembly is attached to the structure using a pair of horizontally transversely spaced wall attachment assemblies, each comprising a respective wall attachment member that contacts and is fastened to the wall surface 14, and a single roof attachment assembly comprising a roof attachment member that contacts and is fastened to the roof surface 12. Each wall attachment member comprises in this embodiment a rectangular metal plate 24 of appropriate thickness, while the roof attachment member comprises a central rectangular metal plate 25 having two rectangular metal side plates 26 attached along its longer sides by hinges 27, this hinging of the plates enabling them to more closely conform to the shape of the roof surface when it is not flat, as in the present embodiment where the roof surface is dome shaped. In other embodiments the side plates may be hinged along the top and bottom edges of the central roof plate, or side plates may provided on all four edges; similarly hingedly connected side plates may be provided at the edges of the wall attachment plate. With a metal structure it may be possible to weld the members to the wall and roof surfaces, but such a method does require the use of special equipment and specially trained personnel, and in other cases welding is not possible or desirable, such as with electric transformers. It is usually found that the simplest and most economical method of attachment is by means of a suitable high strength adhesive, such as that sold by Loctite Corporation, Rocky Hill, Conn. as "LOCTITE 330", and such an adhesive if properly applied and cured has adequate strength for the purpose.

In most cases the post assembly is only required for short periods of time at long and/or infrequent intervals, and the attachment members are sufficiently inexpensive that, once attached to the structure, it is economical to leave them in place while the remainder of the post assembly is removed for use at another site. In order to ensure that it is not required to always use the same post assembly at a particular location, the attachment members are installed using a stub post assembly as shown in FIG. 1, which will ensure that they are always sufficiently accurately placed. The difference between the two assemblies is that the stub post assembly has a stub post member 28 that is only long enough, e.g. about 30 cm (12 ins) to just extend from the required minimum distance below the roof edge to a short distance above the edge, while the post member 28 for the post assembly is much longer, in practise as long as is practical for a convenient size package for transport. A full size post assembly could of course be used for installation but a stub post assembly is much lighter and easier to use for this purpose. Its use emphasizes to the installer the need for uniform accurate installation of the attachment members; for ease of handling a handle 30 is provided.

Each wall attachment plate 24 has a first connection part attached thereto, which in this embodiment comprises two vertically spaced coaxial tubular members 32 snugly receiving a removable pin 34 held therein by a spring retainer. The resulting separable connection, which is described in more detail below, has a connection axis 36 (FIG. 1) that extends at least approximately parallel to the wall surface 14. Both the post and the stub post comprise a length of square cross section hollow metal tube, the post member having telescopically mounted therein an upper extension member 38, also a length of square cross section hollow metal tube. One side of the member 38 is provided with a plurality of longitudinally spaced holes 40 into any one of which a spring urged latch 42 can be engaged to fix the overall length of the post, and therefore the height of the attachment point above the roof surface 12 provided by the upper end of the extension member 38. A ring 44 is welded to the top end of the extension member and comprises means for releasable attachment to the post member of the safety harness snap hook or shackle, or the respective end of the travelling restraint line 22.

Both the post member and the stub post member have telescopically mounted therein at their respective lower ends a lower extension member 46 consisting of a short length of square cross section hollow metal tube, provided in one side wall with longitudinally spaced holes 48, into any one of which a spring urged latch 50 can be engaged. The wall attachment assemblies are fastened to the lower extension member, while the roof attachment assembly is fastened to the main post member, enabling the installer to adjust and fix the vertical distance between the wall and roof attachment assemblies. Such an adjustment may be required, for example, if the initial location chosen for the wall attachment assemblies encounters an obstruction that can be avoided by such adjustment.

A base plate 52 is welded to the lower end of the bottom extension member and has two nut members 54 welded thereto, each nut member and the parts that it receives comprising the second connection part of the respective separable connection that cooperates with the first connection part on the attachment plate 24, this second connection part being removed with the post assembly. Each nut member receives a screw threaded rod 56 which has welded to one end a tubular member 58 which is of length such that it fits snugly between the tubular parts 32 on the attachment plate 24, and of diameter such that it snugly receives the pin 34 to complete the respective releasable connection. The rods 56 are rotatable about respective attachment axes 60 (FIG. 1) that intersect the wall surface 14 and, depending on its direction, such rotation increases or decreases the distance of the lower end of the post and stub post from the wall surface 14 until the post or stub post are vertical, as determined by a spirit level, the pin 34 then being inserted to complete the connection. The pin 34 also acts as a pivot pin about which the attachment plates 24 and the second connection part can hinge to accommodate the curvature of the cylindrical wall 14.

The single releasable roof attachment assembly comprises a screw threaded rod 62 extending vertically from the central roof attachment plate 26 and a connector member 64 mounted on the post and stub post members at a suitable spacing above the wall connector assemblies by a hinge 66 having a horizontal hinge axis 68. The connector member has a plurality of longitudinally spaced holes 70 therein and is swung downward until it is at least approximately horizontal and the rod 62 extends to its maximum extent through the hole 70; the connector member 64 is then fastened thereto by a nut 72.

The installation of a post assembly is begun by placing the stub post assembly in position with the stub post 28 vertical as accurately as possible. The position of the base plate and the wall attachment assemblies is changed, if necessary, by telescoping movement of the bottom extension member 46, and the positions for the roof and wall attachment plates are marked, as indicated in FIG. 1 by boundary lines 74, and the stub assembly is removed. If an adhesive is to be used areas 76 within the lines and immediately around them are cleaned of paint, rust, etc. down to the bare metal. The surfaces of the plates 24, 25 and 26 that contact the wall and roof surfaces are coated with the adhesive, and the stub post assembly is then used to hold the plates accurately in position and to apply pressure thereto until the adhesive has set sufficiently. Once the adhesive has cured for the necessary period, shortened if desired by directing warm air on the plates, the stub post assembly is replaced with the post assembly and work begun. At the end of the operation all that is needed is to remove the nut 72 and the pins 34, when the assembly can be removed for use on the next job.

Any outward force applied to the post member by a worker falling from the roof will have a component that rotates the post outward about the hinge axis 66, producing a pressure force pressing the plates 24 even more strongly into contact with the wall surface. Usually there are not any substantial inward acting forces applied to the post, since normally these would only be caused by a worker trying to reach further than the harness will permit. However, there will also be a strong sideways acting force that is applied by the safety harness to the post member and thereby to the wall attachment plates 24 as a shear force component acting to peel the plates away from the wall surface, and adhesives have much less resistance to such peeling forces than to direct tension forces. The adverse effect of these peeling forces, that would otherwise be fully applied to the adhesive bonds, is reduced by the operation of the two transversely spaced wall attachment plates disposed on opposite sides of the post member. Thus, part of this sideways acting force is converted to inward acting pressure force applied to one of the plates 24 and outward acting tensile force applied to the other plate. This conversion effect can be increased by increasing the transverse spacing between the wall attachment plates, and preferably the spacing should be increased as the distance increases between the bottom end of the post member and the wall surface. This effect is achieved with the apparatus of the invention, without introducing any addition or complication in its structure, by fastening the nut members 54 to the respective base plate 52 with the longitudinal attachment axes 60 diverging away from one another toward the wall surface at an included angle 78 (FIG. 1). The preferred range of values for the angle 78 is from 3° to 10°, while the preferred value is 5°. If this automatic increase in transverse spacing of the wall attachment assemblies is not required, for example in a batch post assemblies intended for use on similar structures, then instead the attachment assemblies can be mounted on a fixed crossbar (not shown) that is in turn mounted at the bottom end of the lower extension 46 and extends horizontal and parallel to the wall surface 14.

Figure 4:
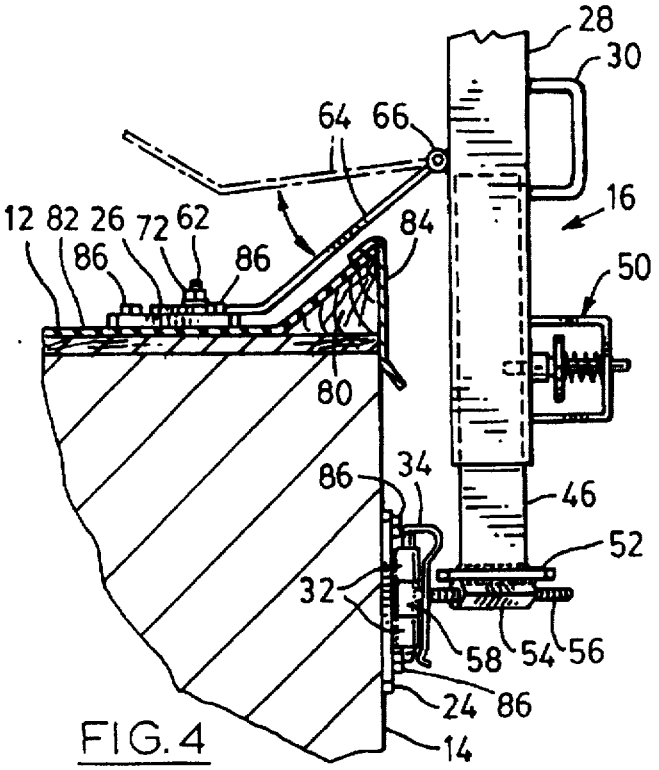
FIG. 4 is a side elevation, partially in section, to show a modified roof attachment assembly used when the post assembly is installed on a conventional flat roofed building.

FIG. 4 shows a modification that may be employed when the post assembly is to be used for mounting a safety harness on a conventional flat roofed building. Such buildings have a cant strip 80 at the roof edge over which the roof covering 82 and flashing 84 are laid; the connector member 64 is made somewhat longer and is of cranked shape downward so that it can extend over this cant strip. FIG. 4 also illustrates an arrangement that can be used if it is preferred not to use an adhesive in fastening the wall and roof attachment assemblies to their respective surfaces, or if it is not possible to use an adhesive. The attachment plates 24, 25 and 26 are made somewhat wider so as to receive bolt holes through which they are fastened, as by lag bolts 86, to the respective surfaces.

In a particular preferred embodiment the plates 24, 25 and 26 are of mild steel of 6.25 mm thickness (0.25 in), are 10 cm (4 in) in length and are 7.5 cm (3 in) wide. The post and stub post members 28 are of H.S.S. seamless square cross section steel tube of exterior side 3.75 cm (1.5 ins), while the bottom extensions 46 and the upper post extension 38 are of the same type of tube of exterior side 3.125 cm (1.25 in), the smaller tubes being a close sliding fit within the larger tubes. The length of the post member 38 is usually about 75 cm (30 ins), while that of the extension member 38 is usually also about 75 cm (30 in), the assembly usually being adjusted to give a total height of the attachment ring above the roof surface of about 120 cm (4 ft), namely at about the height of the back of the average worker; this will then be used with a tether line 18 of about 240 cm (8 ft) length. Because of the relatively small and convenient size of the assembly parts the assemblies are easily handled and stored and moved from job to job as required. A typical initial order for such equipment consists, for example, of a single stub post assembly, a number of post assemblies corresponding to the number of safety harnesses and/or restraint lines likely to be used, and a greater number of wall and roof attachment members that are to be left at the job sites once installed.

I claim:

1. A safety harness attachment post assembly for releasable attachment to and support by a wall surface and a roof surface of a structure on which it is mounted, the assembly comprising:

a post member which when attached to the wall and roof surfaces extends generally vertically with an upper end above the roof surface and a lower end below the roof surface, the post member having at its upper end means for releasable attachment thereto of a safety harness permitting movement of a worker wearing the harness on the roof surface;

two transversely spaced separable wall attachment assemblies at or adjacent to the post member lower end on opposite sides thereof for attachment of the post member to the wall surface so as to withstand the weight of the assembly and forces applied thereto by an attached safety harness;

each wall attachment assembly being adapted for releasable attachment of the post assembly to the wall surface and comprising a wall attachment plate member attachable to the wall surface and having a first connection part thereon, a second connection part on the post member, and wall attachment assembly connecting means separably connecting together the first and second connection parts, whereby removal of the respective connecting means leaves the corresponding plate member and its first connection part attached to the wall surface;

the transverse spacing of the two wall attachment assemblies and their disposition on opposite sides of the post member providing that part of sideways force acting parallel to the wall surface and applied by the safety harness to the post member and thereby to the wall attachment plate members is converted from shear peeling force to compressive force acting inward toward the wall surface on one wall attachment plate member and to tensile force acting outward away from the wall surface on the other wall attachment plate member; and a roof attachment assembly intermediate the post member ends for releasable attachment of the post assembly to the roof surface so as to withstand the weight of the assembly and forces applied thereto by an attached safety harness, the assembly comprising a roof attachment assembly plate member attachable to the roof surface and having a first connection part thereon, a second connection part on the post member, and roof attachment assembly connecting means separably connecting together the first and second connection parts, whereby removal of the respective connecting means leaves the corresponding plate member and its first connection part attached to the roof surface.

2. A post assembly as claimed in claim 1, wherein the second connection part of each wall attachment assembly has a longitudinal axis that when the post assembly is installed intersects the wall surface and along which the distance of the lower end of the post member from the respective wall attachment member can be adjusted, and wherein the two axes diverge away from one another toward the wall surface whereby the transverse spacing between the wall attachment members increases as the spacing increases of the lower end of the post member from the wall surface.

3. A post assembly as claimed in claim 1, wherein in each wall attachment assembly the first connection part comprises first and second vertically spaced coaxial tubular members on the wall attachment plate member;

the second connection part comprises a third tubular member of length to fit snugly between the first and second tubular members so as to be coaxial therewith, a screw threaded rod extending horizontally therefrom, and a nut member at the lower end of the post member and in which the screw threaded rod is rotatable to change the spacing between the third tubular member and the post member and thereby the spacing between the post member lower end and the wall surface; and the wall attachment assembly connecting means comprises a cylindrical connection pin engageable in the three tubular members to connect them together.

4. A post assembly as claimed in claim 1, wherein each attachment plate member comprises a main plate and at least one additional plate hinged to the main plate so that the hinged main and additional plates can together more closely conform to the shape of the surface to which they are attached.

5. A post assembly as claimed in claim 1, wherein the roof attachment assembly first connection part comprises a screw threaded rod extending upward from the roof attachment assembly plate member;

the second connection part comprises a connector member on the post member and extending generally horizontally therefrom, the connector member having a hole through which the screw threaded rod extends when it is engaged thereon; and the roof attachment assembly connection means comprises a nut which is screwed on to the screw threaded rod to retain the connector member thereon.

6. A post assembly as claimed in claim 5, wherein the connector member is pivotally connected to the post member about a horizontal axis to facilitate engagement of the connector member on the screw threaded rod.

7. A post assembly as claimed in claim 5, wherein the connector member is of cranked shape downward along its length to facilitate its engagement on the screw threaded rod as it extends over an edge of the structure roof surface.

8. A post assembly as claimed in claim 1, wherein the post member comprises a main part to which the wall and roof attachment assemblies are attached, and an upper extension part telescoping within the main part for adjustment of the height of the post member upper end above the roof surface and to the upper end of which the means for releasable attachment of a safety harness is attached, and means for fixing the position of the two parts relative to one another so as to fix the length of the post member.

9. A post assembly as claimed in claim 1, wherein the post member comprises a main part to which the roof attachment assembly is attached, and a lower extension part telescoping within the main part and to which the wall attachment assemblies are attached, and means for fixing the position of the two post member parts relative to one another, whereby the spacing between the wall and roof attachment assemblies can be changed.

10. A safety harness attachment stub post assembly for releasable attachment of two transversely spaced wall surface attachment assemblies to a wall surface of a structure and of a roof surface attachment assembly to a roof surface of the structure so as to permit the subsequent attachment to and support by the wall and roof surfaces of a safety harness attachment post assembly, the stub post assembly comprising:

a stub post member which when attached to the wall and roof surfaces extends generally vertically with an upper end at least at the level of the roof surface and a lower end below the roof surface, the stub post member, the stub post member corresponding to a post member having at its upper end means for releasable attachment thereto of a safety harness;

two transversely spaced separable wall attachment assemblies at or adjacent to the stub post member lower end on opposite sides thereof for subsequent attachment of the safety harness attachment post assembly to the wall surface so as to withstand the weight of the assembly and forces applied thereto by an attached safety harness;

each wall attachment assembly being adapted for releasable attachment of the stub post assembly to the wall surface and comprising a wall attachment plate member attachable to the wall surface and having a first connection part thereon, a second connection part on the stub post member, and wall attachment assembly connecting means separably connecting together the first and second connection parts, whereby removal of the respective connecting means leaves the corresponding plate member and its first connection part attached to the wall surface;

the transverse spacing of the two wall attachment assemblies and their disposition on opposite sides of the stub post member providing that part of sideways force acting parallel to the wall surface that would be applied by the safety harness to a post member and thereby to the wall attachment plate members will be converted from shear peeling force to compressive force acting inward toward the wall surface on one wall attachment plate member and to tensile force acting outward away from the wall surface on the other wall attachment plate member; and a roof attachment assembly at the stub post member upper end for releasable attachment of the post assembly to the roof surface so as to withstand the weight of the assembly and forces applied thereto by an attached safety harness, the assembly comprising a roof attachment assembly plate member attachable to the roof surface and having a first connection part thereon, a second connection part on the stub post member, and roof attachment assembly connecting means separably connecting together the first and second connection parts, whereby removal of the respective connecting means leaves the corresponding plate member and its first connection part attached to the roof surface.

11. A stub post assembly as claimed in claim 10, wherein the second connection part of each wall attachment assembly has a longitudinal axis that when the stub post assembly is installed intersects the wall surface and along which the distance of the lower end of the stub post member from the respective wall attachment member can be adjusted, and wherein the two axes diverge away from one another toward the wall surface whereby the transverse spacing between the wall attachment members increases as the spacing increases of the lower end of the stub post member from the wall surface.

12. A stub post assembly as claimed in claim 10, wherein in each wall attachment assembly the first connection part comprises first and second vertically spaced coaxial tubular members on the wall attachment plate member;

the second connection part comprises a third tubular member of length to fit snugly between the first and second tubular members so as to be coaxial therewith, a screw threaded rod extending horizontally therefrom, and a nut member at the lower end of the stub post member and in which the screw threaded rod is rotatable to change the spacing between the third tubular member and the stub post member and thereby the spacing between the stub post member lower end and the wall surface; and the wall attachment assembly connecting means comprises a cylindrical connection pin engageable in the three tubular members to connect them together.

13. A stub post assembly as claimed in claim 10, wherein each attachment plate member comprises a main plate and at least one additional plate hinged to the main plate so that the hinged main and additional plates can together more closely conform to the shape of the surface to which they are attached.

14. A stub post assembly as claimed in claim 10, wherein the roof attachment assembly first connection part comprises a screw threaded rod extending upward from the roof attachment plate member;

the second connection part comprises a connector member on the stub post member and extending generally horizontally therefrom, the connector member having a hole through which the screw threaded rod extends when it is engaged thereon; and the roof attachment assembly connection means comprises a nut which is screwed on to the screw threaded rod to retain the connector member thereon.

15. A stub post assembly as claimed in claim 14, wherein the connector member is pivotally connected to the stub post member about a horizontal axis to facilitate engagement of the connector member on the screw threaded rod.

16. A stub post assembly as claimed in claim 14, wherein the connector member is of cranked shape downward along its length to facilitate its engagement on the screw threaded rod as it extends over an edge of the structure roof surface.

17. A stub post assembly as claimed in claim 10, wherein the stub post member comprises a main part to which the roof attachment assembly is attached, and a lower extension part telescoping within the main part and to which the wall attachment assemblies are attached, and means for fixing the position of the two post member parts relative to one another, whereby the spacing between the wall and roof attachment assemblies can be changed.

* * * * *